United States Patent [19]

Newick

[11] 4,196,687

[45] Apr. 8, 1980

[54] ROLLER REEFING SYSTEM

[76] Inventor: Richard C. Newick, R.F.D., Vineyard Haven, Mass. 02568

[21] Appl. No.: 875,099

[22] Filed: Feb. 3, 1978

[51] Int. Cl.[2] ..... B63H 9/04

[52] U.S. Cl. ..... 114/106; 114/107

[58] Field of Search ..... 114/102, 103, 104, 105, 114/106, 107, 39

[56] References Cited

U.S. PATENT DOCUMENTS

| | | | |
|---|---|---|---|
| 3,749,043 | 7/1973 | Crall | 114/106 |
| 3,938,460 | 2/1976 | Wales | 114/106 |

*Primary Examiner*—Douglas C. Butler
*Assistant Examiner*—D. W. Keen
*Attorney, Agent, or Firm*—Pasquale A. Razzano; William S. Frommer

[57] ABSTRACT

A roller reefing system for reefing any sail (e.g. main, mizzen, staysail, jib or genoa) of a sailboat is disclosed which includes an elongated insert element operatively connected to the luff or leading edge of the sail, and having a predetermined continuously contoured configuration or variable cross-section along its length, to accommodate sail fullness during furling and unfurling operations.

6 Claims, 7 Drawing Figures

FIG. 1
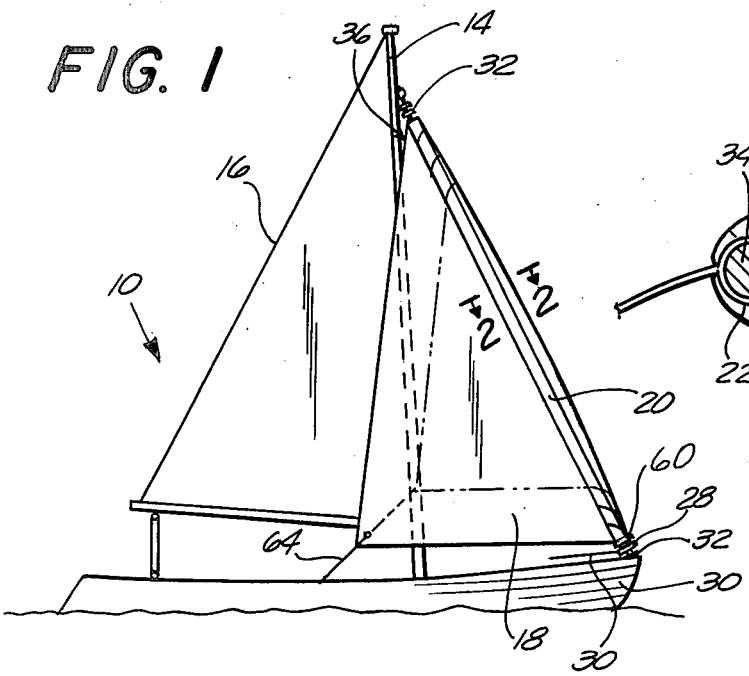
FIG. 2
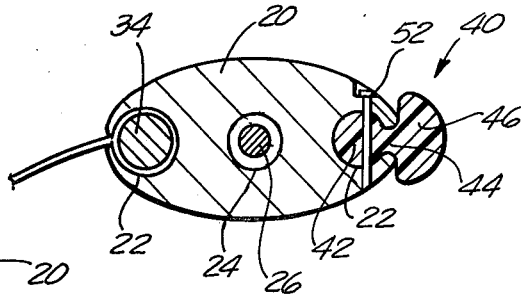
FIG. 3
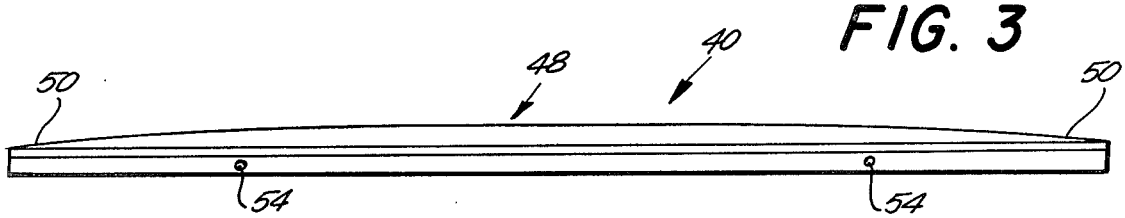
FIG. 4
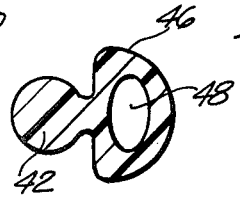
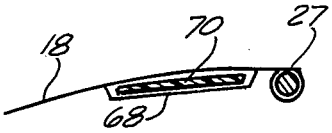
FIG. 7
FIG. 5
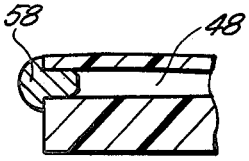
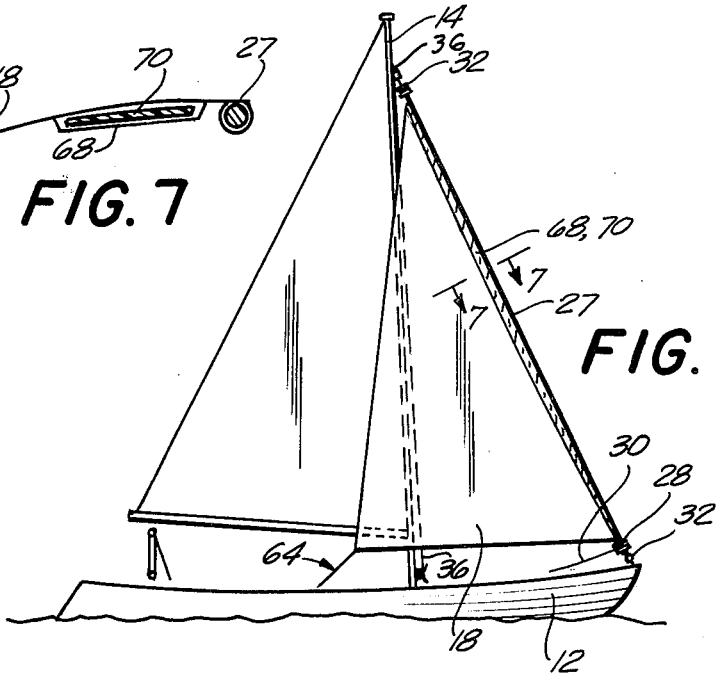
FIG. 6

ROLLER REEFING SYSTEM

The present invention relates to roller reefing systems, and more particularly to a roller reefing element which is adapted to be used with existing sails and reefing stays of conventional construction.

In both pleasure and racing sailboats it is common to carry several different types and sizes of sails, particularly jib, stay and genoa sails, in order to accommodate varying wind conditions. The particular sail used is determined by wind conditions, and thus it is often necessary to change sails from time to time, particularly when racing.

Attempts have been made in the past to avoid the need for changing sails in this manner, particularly in pleasure sailboats, by providing a roller reefing system along the luff of the sail, to permit the sail to be rolled up along its luff on a rigid roller or the like. However, while this seems a satisfactory solution in principle, previously proposed systems for roller reefing have not been entirely satisfactory in practice.

The sails of a boat drive the boat to windward efficiently because of their curved air foil shaped cross-section. This curvature in the sail is achieved by putting "fullness" into the middle of the sail. Less fullness is desired in strong winds, at the same time that less sail area is required. With existing roller reefing systems a sail that sets with optimum fullness when not reefed, becomes too full as it is rolled up to reduce its sail area because of the constant cross-section of the roll which forces the fullness of the center of the sail into an increasingly smaller exposed area. Thus the sail does not operate at the desired efficiency in its reefed condition. As an alternative to such conventional roller reefing systems, the sailor has the option of using no roller reefing system and simply changing sails as conditions vary, or using a somewhat more complicated roller reefing system consisting of a plurality of differently shaped roller sections, disclosed for example in U.S. Pat. No. 3,749,043. However, that system is relatively complex and heavy; thus making it difficult to use satisfactorily.

It is an object of the present invention to provide means adapted for use with conventional roller reefing systems, or with sails that are not normally used with roller reefing systems, to enable the sailor to adjust the exposed sail area in accordance with sailing conditions.

Another object of the present invention is to provide a device adapted to be used with existing sailing equipment for roller reefing sails, which will keep the sail fullness at the optimum curve for however much of the sail it is desired to set.

Another object of the present invention is to provide a roller reefing system which is equally adaptable to main sails, jibs, or genoas.

A still further object of the present invention is to provide an insert reefing element adapted for use with conventional roller furling systems, such as for example are sold by Hood and Stearn.

A still further feature of the present invention is to control the shape of the sail throughout the reefing operation and in all reefed positions thereof.

In accordance with an aspect of the present invention, a roller reefing system is provided which includes a flexible one-piece reefing element having a predetermined contour and adapted to be connected to the luff of a sail, with the contour of the reefing element being selected to accommodate and take up the fullness of the middle of the sail when the sail is reefed. In one embodiment of the invention the insert has a cross-section similar to a "figure 8" and is formed as a plastic extrusion. One rib or section of the extrusion is dimensioned to fit into the unused boltrope slot or luff groove of a two boltrope slot reefing or furling system. Such systems have been used heretofore to permit rapid change of sails, by inserting the luff of one sail in one of the grooves and setting the sail while the other sail, whose luff is mounted in the other of the grooves, is still set.

When a solid insert is used in accordance with one embodiment of the invention, it is tapered towards its ends so that the middle portion of the insert is full and gradually tapers to a very small cross-section at the tack and head of the sail. The amount of taper and its dimension is selected to suit the fullness of the sail with which the insert is used. As a result, the cross-section of the reefing or furling stay of conventional systems, which is generally uniform throughout its entire length, can be made to vary by as much as 10% along the length of the stay.

The above, and other objects, features and advantages of this invention will be apparent in the following detailed description of an illustrative embodiment thereof, which is to be read in connection with the accompanying drawings, wherein:

FIG. 1 is a side elevational view of a sailboat on which the reefing element of the present invention is adapted to be used;

FIG. 2 is a sectional view taken along line 2—2 of FIG. 1, showing the insert element of the invention mounted in a conventional reefing stay;

FIG. 3 is a side elevational view of the reefing insert element according to one embodiment of the present invention;

FIG. 4 is a sectional view of a reefing element according to a second embodiment of the invention;

FIG. 5 is a partial side sectional view of the reefing element shown in FIG. 4;

FIG. 6 is a side view, similar to FIG. 1, showing a sailboat using a reefing system according to yet another embodiment of the present invention; and FIG. 7 is a sectional view taken along line 7—7 of FIG. 6

Referring now to the drawing in detail, and initially to FIG. 1 thereof, a sailboat 10 of conventional construction is illustrated which includes a conventional hull 12, a main mast 14 on which a main sail 16 is set, and a jib or stay sail 18. In the illustrative embodiment, the stay sail 18 is mounted on a conventional roller stay or foil 20, such as is available from Hood or Stearn. This stay consists of a rigid lightweight member, having a generally oval cross-section and a pair of boltrope or luff rope grooves 22 formed therein on its opposite sides. The stay or foil may be formed of any lightweight torque resistant material, usually aluminum, either as a solid one piece element or of assembled sections with a central opening 24 for stay 26 about which the foil rotates on swivels, attached top and bottom. The lower end of the stay 20 has rigidly mounted on it a drum 60 containing wire or line 30 which can be pulled to rotate the sail about stay 26 or 20 as sheet 64 is slackened in order to reef the sail. Both ends of stay 26 or 20 are connected to swivels 32.

The luff of a sail is typically provided with a cable or boltrope 34 secured therein, which rope is slidably engaged in one of the grooves 22 of stay 20. The head of the sail is secured to a halyard 36 by which the sail can be raised to its set position, by pulling the luff of the sail through groove 22. The other groove 22, in the conventional operation, remains open and available for use, so that when it is desired to change sails, one sail can be set by placing its boltrope in the available groove 22 and raising the sail in the lee of the already set sail, which is only lowered when the new sail is already in position. This permits rapid sail change with one sail always working. When it is desired to reef a sail, using this conventional type of stay, the stay is rotated by control cable 30, as described above, and the luff of the sail is wound on the stay. However because of the uniform cross-section of the stay the fullness of the sail is not properly accommodated.

In accordance with the present invention, the conventional rigid stay 20 is provided with a reefing insert 40, which permits the effective cross-section of stay 20 to be varied along its length, so that uniform reefing of the sail can be achieved.

In the embodiment of the invention illustrated in FIG. 2, insert element 40 consists of a one-piece extrusion having a cross-section generally similar to a "figure 8". Basically, the extrusion includes an elongated rib 42 having a generally circular cross-section which extends along the entire length of the insert. This rib is connected by a neck 44 to a semi-circular contoured section 46. Preferably this contoured section tapers generally continuously from the center 48 of the insert, where the radius of its semi-circular cross-section as a maximum, to a minimum cross-section at the ends 50 thereof. The specific degree of taper, and the specific dimensions of the cross-sectional radius of contoured section 40 of the insert, may be varied in accordance with the type and brand of sail with which the insert is being used.

The insert is preferably formed of a resilient flexible plastic material, (e.g. polyvinyl chloride) so that it is readily slid into the boltrope groove 22 of the stay 20. It may be locked in place frictionally, although it is preferred that locking pins 52 or the like be inserted through openings 54 in the insert and in stay 20, to hold the insert in position. While the insert may be molded with the desired shape, it is contemplated that it can be formed of an extruded material in a uniform cross-section and, after extrusion, be cut and tapered to the desired taper, either mechanically or manually. When not in use, the flexible insert is readily coiled into a small roll for storage. By this arrangement, it will be appreciated that the effective cross-sectional area of the stay 20 is varied along its length, by the contoured section of the profile or insert, so that the fullness of the center of the sail can be accommodated on the profile when the stay 20 is rotated to reef the sail.

Another embodiment of the invention is illustrated in FIGS. 4 and 5. In this embodiment insert 40, is also formed as an extruded element, but with its normal exposed or contoured section 46 having a substantially uniform cross-section along its entire length, and including a central opening or passage 48 therein. The ends of the passage 48 are closed by plugs 58, in any convenient manner, so that the passage 48 is essentially air tight, although its walls are resilient. This insert is inserted in stay 20 in the same manner as in the previously described insert, by placing rib 42 in boltrope groove 22 and pinning the insert in place with the aid of the pins 52.

In the unreefed condition of the sail, the effective cross-section of stay 20 is simply increased by the uniform cross-section of insert 40. However, as the sail is reefed, and rolled on stay 20, most of the stress in the sail, as a result of the reefing operation, is applied to the least full head and tack (top and bottom) of the sail. This stress is applied to insert 40 and collapses the hollow contoured section 46 thereof, forcing air in the passage 48 to the middle of the contoured section where more fullness is desired. Thus the middle of the contoured section is enlarged by the additional air pressure therein while the ends of the contoured section are depressed, with the result that the original contour of the insert is varied to accommodate the fullness of the sail as the sail is reefed.

A still further embodiment of the invention is illustrated in FIG. 6 of the drawing. This embodiment is suitable for use with Stearn and Hood roller reefing systems of the type previously described, as well as with simpler sailing equipment manufactured by Schaefer, Merriman, and others, in which the sail is "set flying", i.e., not hanked to a stay, and is rotated about its own bolt or luff rope to reef or to furl. As illustrated in FIG. 6, in this instance, the sail "set flying" is secured only at its three corners. It is secured at the top by halyard 36 with swivel 66 between the sail and halyard. The lower forward or tack of the sail is secured to the deck with a swivel 32. Between the swivel and sail a drum 28 is provided containing reefing line 30 which, when pulled, rotates the sail to reef it around boltrope 27 as sheet 64 is slacked.

In accordance with the present invention however, sail 18 is modified by sewing a pocket or sleeve 68 along the luff of the sail (see FIG. 7). This pocket is filled with an approximately one-quarter inch thick unicellular plastic foam 70, such as for example sold under the tradename "ENSOLITE". This pocket tapers from nothing (i.e. a minimum dimension) at the bottom of the sail to a maximum of about four inches wide halfway up the sail. The width actually used depends upon the size and fullness of the particular sail. Then the pocket tapers slightly towards the top or head of the sail, but still retaning substantial width. This tapered configuration for the pocket and the foam insert contained therein is selected since the reefing torque is applied at the foot of the sail by the drum 28, and is transmitted with less effectiveness to the sail as the distance from the foot increases so that, as a result, the head of the sail is rotated less than the foot or tack of the sail. Thus the thicker top portion of the pocket insures uniform reefing. Moreover, the increased fullness or thickness of the sail along its luff, supplied by the foam insert 70, permits the sail to set in a more uniform manner when it is reefed, about its own boltrope, or even when used on or in conjunction with a conventional roller reefing such as that shown at 20 in FIG. 2.

Although an illustrative embodiment of the present invention has been described herein with reference to the accompanying drawings, it is to be understood that the invention is not limited to that precise embodiment, and that various changes and modifications may be effected therein by one skilled in the art without departing from the scope or spirit of this invention. For example, although jibs, genoas, and staysails are used in the above description and illustration, the same principles apply equally to roller reefing main sails and mizzen sails, whether housed inside or outside of the mast.

What is claimed is:

1. Roller sail reefing apparatus adapted to be mounted in a luff rope groove of a multi grooved roller furling stay comprising a one piece elongated insert element having an elongated rib formed thereon adapted to be received in the luff rope groove of a grooved roller furling stay and a section secured to said rib having a semi-circular shape in cross-section which, in opertion, varies the effective cross-section of the furling stay along its length when the sail is furled, said section extending beyond the periphery of the stay in which the insert is mounted.

2. Roller sail reefing apparatus as defined in claim 1 wherein said section secured to said rib is tapered along its length, having a central relatively large cross-section and smaller cross-sections adjacent its ends.

3. Roller sail reefing apparatus as defined in claim 1 wherein said section secured to said rib has a substantially uniform cross-section and has an elongated hollow passage formed therein, said section being formed of a resilient material whereby the cross-section thereof will vary in response to pressure exerted thereon adjacent said passage.

4. Roller sail reefing apparatus adapted to be mounted in a luff rope groove of a multi grooved roller furling stay comprising an elongated one-piece insert element having an elongated rib formed thereon adapted to be received in the luff rope groove of a grooved roller furling stay and variably contoured surface portion secured to said rib and extending beyond the periphery of the stay in which the insert is mounted, thereby to vary the effective cross-section of the stay along its length.

5. Roller sail reefing apparatus as defined in claim 4 wherein said contoured surface portion is generally semi-circular in cross-section and has a radius which decreases from a maximum adjacent the central portion of the insert to a minimum adjacent its ends.

6. Roller sail reefing apparatus as defined in claim 4 wherein said contoured surface portion is generally semi-circular in cross-section and has an elongated hollow passage formed therein and closed at its opposite ends, said insert being formed of a resilient material whereby the cross-section of said contoured portion of the insert will vary in response to pressure exerted thereon.

* * * * *